US007226668B2

(12) United States Patent
Nagaraj et al.

(10) Patent No.: US 7,226,668 B2
(45) Date of Patent: Jun. 5, 2007

(54) THERMAL BARRIER COATING CONTAINING REACTIVE PROTECTIVE MATERIALS AND METHOD FOR PREPARING SAME

(75) Inventors: Bangalore Aswatha Nagaraj, West Chester, OH (US); Irene Spitsberg, Loveland, OH (US)

(73) Assignee: General Electric Company, Schenectady, NY (US)

( * ) Notice: Subject to any disclaimer, the term of this patent is extended or adjusted under 35 U.S.C. 154(b) by 756 days.

(21) Appl. No.: 10/317,759

(22) Filed: Dec. 12, 2002

(65) Prior Publication Data

US 2004/0115471 A1 Jun. 17, 2004

(51) Int. Cl.
*B32B 15/04* (2006.01)
*F03B 3/12* (2006.01)

(52) U.S. Cl. ..... 428/632; 428/701; 428/702; 416/241 B

(58) Field of Classification Search ..... 427/453; 428/632, 633, 621, 650, 679, 680, 697, 699, 428/701, 702, 332, 336, 469, 655, 472; 416/241 B
See application file for complete search history.

(56) References Cited

U.S. PATENT DOCUMENTS

| | | | |
|---|---|---|---|
| 4,116,723 | A | 9/1978 | Gell et al. |
| 4,741,286 | A | 5/1988 | Itoh et al. |
| 5,047,612 | A | 9/1991 | Savkar et al. |
| 5,332,598 | A | 7/1994 | Kawasaki et al. |
| 5,399,313 | A | 3/1995 | Ross et al. |
| 5,641,440 | A | 6/1997 | Talmy et al. |

(Continued)

FOREIGN PATENT DOCUMENTS

| | | |
|---|---|---|
| EP | 1088908 | 4/2001 |

(Continued)

OTHER PUBLICATIONS

U.S. Appl. No. 10/317,732, filed Dec. 12, 2002, Bangalore Aswatha Nagaraj et al.

(Continued)

*Primary Examiner*—Jennifer McNeil
(74) *Attorney, Agent, or Firm*—Jagtiani + Guttag; Eric W. Guttag; Ted Cummings

(57) ABSTRACT

A thermal barrier coating for an underlying metal substrate of articles that operate at, or are exposed to, high temperatures, as well as being exposed to environmental contaminant compositions. This coating comprises an inner layer nearest to the underlying metal substrate comprising a ceramic thermal barrier coating material, as well as an outer layer having an exposed surface and comprising a CMAS-reactive material in an amount up to 100% and sufficient to protect the thermal barrier coating at least partially against CMAS that becomes deposited on the exposed surface, the CMAS-reactive material comprising an alkaline earth aluminate or alkaline earth aluminosilicate where the alkaline earth is selected from barium, strontium and mixtures thereof, and optionally a ceramic thermal barrier coating material. This coating can be used to provide a thermally protected article having a metal substrate and optionally a bond coat layer adjacent to and overlaying the metal substrate. The thermal barrier coating can be prepared by forming the inner layer of the ceramic thermal barrier coating material, followed by depositing the CMAS-reactive material, or codepositing the CMAS-reactive material and the ceramic thermal barrier coating material, to form the outer layer.

31 Claims, 1 Drawing Sheet

U.S. PATENT DOCUMENTS

| | | | |
|---|---|---|---|
| 5,660,885 | A | 8/1997 | Hasz et al. |
| 5,985,470 | A | 11/1999 | Spitsberg et al. |
| 6,025,078 | A | 2/2000 | Rickersby et al. |
| 6,117,560 | A | 9/2000 | Maloney |
| 6,177,200 | B1 | 1/2001 | Maloney |
| 6,254,935 | B1 * | 7/2001 | Eaton et al. |
| 6,284,323 | B1 | 9/2001 | Maloney |
| 6,294,261 | B1 | 9/2001 | Sangeeta et al. |
| 6,299,988 | B1 | 10/2001 | Wang et al. |
| 6,319,614 | B1 | 11/2001 | Beele |
| 6,333,118 | B1 | 12/2001 | Alperine et al. |
| 6,352,790 | B1 | 3/2002 | Eaton et al. |
| 6,365,288 | B1 | 4/2002 | Eaton et al. |
| 6,387,456 | B1 * | 5/2002 | Eaton et al. |
| 6,387,526 | B1 | 5/2002 | Beele |
| 6,410,148 | B1 | 6/2002 | Eaton, Jr. et al. |
| 6,444,335 | B1 * | 9/2002 | Wang et al. |
| 6,548,190 | B2 * | 4/2003 | Spitsberg et al. |
| 6,558,814 | B2 * | 5/2003 | Spitsberg et al. |
| 2003/0003318 | A1 | 1/2003 | Spitsberg et al. |

FOREIGN PATENT DOCUMENTS

| | | |
|---|---|---|
| EP | 1142850 | 10/2001 |

OTHER PUBLICATIONS

U.S. Appl. No. 10/317,730, filed Dec. 12, 2002, Bangalore Aswatha Nagaraj et al.

U.S. Appl. No. 10/317,731, filed Dec. 12, 2002, Bangalore Aswatha Nagaraj et al.

U.S. Appl. No. 10/317,758, filed Dec. 12, 2002, John Frederick Ackerman et al.

C.Ramachandra et al., "Durability of TBCs with a surface environmental barrier layer under thermal cycling in air and in molten salt," Surface and Coatings Technology, 172 (2003), pp. 150-157.

* cited by examiner

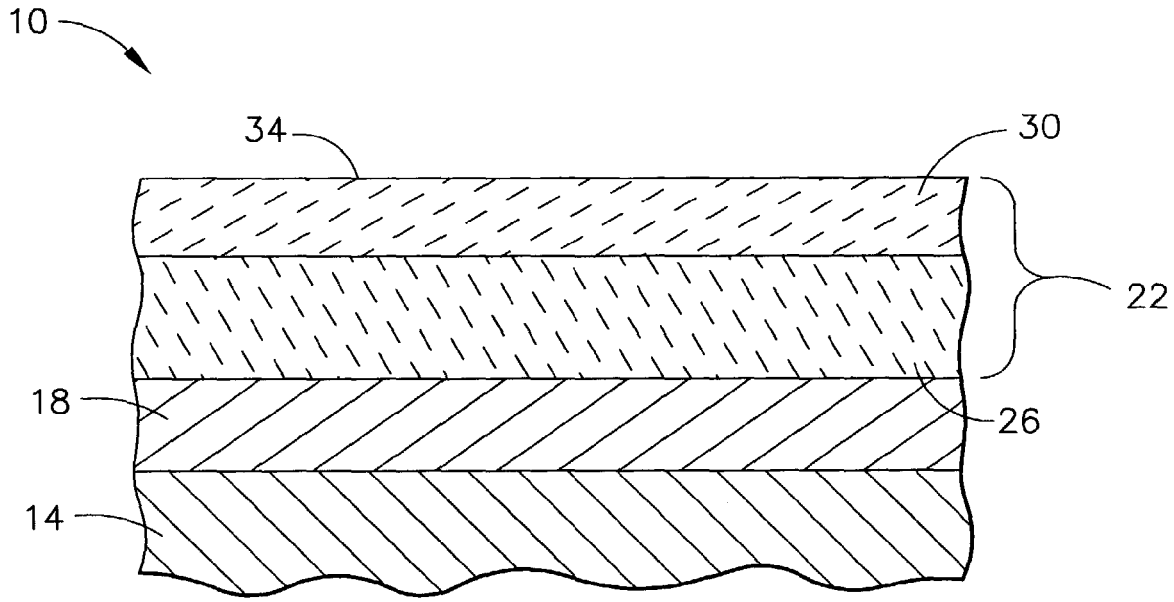
10
34
30
22
18
26
14

THERMAL BARRIER COATING CONTAINING REACTIVE PROTECTIVE MATERIALS AND METHOD FOR PREPARING SAME

STATEMENT REGARDING FEDERALLY SPONSORED RESEARCH

This invention was made with Government support under Contract No. N00019-96-C-0176 awarded by the Department of the Navy. The Government has certain rights to the invention.

BACKGROUND OF THE INVENTION

The present invention relates to thermal barrier coatings containing reactive materials, such as alkaline earth aluminates or aluminosilicates, for protection and mitigation against environmental contaminants, in particular oxides of calcium, magnesium, aluminum, silicon, and mixtures thereof that can become deposited onto such coatings. The present invention further relates to articles with such coatings and a method for preparing such coatings for the article.

Thermal barrier coatings are an important element in current and future gas turbine engine designs, as well as other articles that are expected to operate at or be exposed to high temperatures, and thus cause the thermal barrier coating to be subjected to high surface temperatures. Examples of turbine engine parts and components for which such thermal barrier coatings are desirable include turbine blades and vanes, turbine shrouds, buckets, nozzles, combustion liners and deflectors, and the like. These thermal barrier coatings are deposited onto a metal substrate (or more typically onto a bond coat layer on the metal substrate for better adherence) from which the part or component is formed to reduce heat flow and to limit the operating temperature these parts and components are subjected to. This metal substrate typically comprises a metal alloy such as a nickel, cobalt, and/or iron based alloy (e.g., a high temperature superalloy).

The thermal barrier coating usually comprises a ceramic material, such as a chemically (metal oxide) stabilized zirconia. Examples of such chemically stabilized zirconias include yttria-stabilized zirconia, scandia-stabilized zirconia, calcia-stabilized zirconia, and magnesia-stabilized zirconia. The thermal barrier coating of choice is typically a yttria-stabilized zirconia ceramic coating. A representative yttria-stabilized zirconia thermal barrier coating usually comprises about 7% yttria and about 93% zirconia. The thickness of the thermal barrier coating depends upon the metal substrate part or component it is deposited on, but is usually in the range of from about 3 to about 70 mils (from about 75 to about 1795 microns) thick for high temperature gas turbine engine parts.

Under normal conditions of operation, thermal barrier coated metal substrate turbine engine parts and components can be susceptible to various types of damage, including erosion, oxidation, and attack from environmental contaminants. At the higher temperatures of engine operation, these environmental contaminants can adhere to the heated or hot thermal barrier coating surface and thus cause damage to the thermal barrier coating. For example, these environmental contaminants can form compositions that are liquid or molten at the higher temperatures that gas turbine engines operate at. These molten contaminant compositions can dissolve the thermal barrier coating, or can infiltrate its porous structure, i.e., can infiltrate the pores, channels or other cavities in the coating. Upon cooling, the infiltrated contaminants solidify and reduce the coating strain tolerance, thus initiating and propagating cracks that cause delamination, spalling and loss of the thermal barrier coating material either in whole or in part.

These pores, channel or other cavities that are infiltrated by such molten environmental contaminants can be created by environmental damage, or even the normal wear and tear that results during the operation of the engine. However, this porous structure of pores, channels or other cavities in the thermal barrier coating surface more typically is the result of the processes by which the thermal barrier coating is deposited onto the underlying bond coat layer-metal substrate. For example, thermal barrier coatings that are deposited by (air) plasma spray techniques tend to create a sponge-like porous structure of open pores in at least the surface of the coating. By contrast, thermal barrier coatings that are deposited by physical (e.g., chemical) vapor deposition techniques tend to create a porous structure comprising a series of columnar grooves, crevices or channels in at least the surface of the coating. This porous structure can be important in the ability of these thermal barrier coating to tolerate strains occurring during thermal cycling and to reduce stresses due to the differences between the coefficient of thermal expansion (CTE) of the coating and the CTE of the underlying bond coat layer/substrate.

For turbine engine parts and components having outer thermal barrier coatings with such porous surface structures, environmental contaminant compositions of particular concern are those containing oxides of calcium, magnesium, aluminum, silicon, and mixtures thereof. See, for example, U.S. Pat. No. 5,660,885 (Hasz et al), issued Aug. 26, 1997 which describes these particular types of oxide environmental contaminant compositions. These oxides combine to form contaminant compositions comprising mixed calcium-magnesium-aluminum-silicon-oxide systems (Ca—Mg—Al—SiO), hereafter referred to as "CMAS." During normal engine operations, CMAS can become deposited on the thermal barrier coating surface, and can become liquid or molten at the higher temperatures of normal engine operation. Damage to the thermal barrier coating typically occurs when the molten CMAS infiltrates the porous surface structure of the thermal barrier coating. After infiltration and upon cooling, the molten CMAS solidifies within the porous structure. This solidified CMAS causes stresses to build within the thermal barrier coating, leading to partial or complete delamination and spalling of the coating material, and thus partial or complete loss of the thermal protection provided to the underlying metal substrate of the part or component.

Accordingly, it would be desirable to protect these thermal barrier coatings having a porous surface structure against the adverse effects of such environmental contaminants when used with a metal substrate for a turbine engine part or component, or other article, operated at or exposed to high temperatures. In particular, it would be desirable to be able to protect such thermal barrier coatings from the adverse effects of deposited CMAS.

BRIEF DESCRIPTION OF THE INVENTION

The present invention relates to a thermal barrier coating for an underlying metal substrate of articles that operate at, or are exposed, to high temperatures, as well as being exposed to environmental contaminant compositions, in particular CMAS. This thermal barrier coating comprises:

a. an inner layer nearest to and overlaying the metal substrate and comprising a ceramic thermal barrier coating material in an amount up to 100%; and;

b. an outer layer adjacent to and overlaying the inner layer and having an exposed surface, and comprising:

(1) a CMAS-reactive material in an amount up to 100% and sufficient to protect the thermal barrier coating at least partially against CMAS that becomes deposited on the exposed surface, the CMAS-reactive material comprising an alkaline earth aluminate, alkaline earth aluminosilicate or mixture thereof, wherein the alkaline earth is selected from the group consisting of barium, strontium and mixtures thereof; and (2) optionally a ceramic thermal barrier coating material.

The present invention also relates to a thermally protected article. This protected article comprises:

a. a metal substrate;

b. optionally a bond coat layer adjacent to and overlaying the metal substrate; and c. a thermal barrier coating as previously describe adjacent to and overlaying the bond coat layer (or overlaying the metal substrate if the bond coat layer is absent).

The present invention further relates to a method for preparing the thermal barrier coating. This method comprises the steps of:

1. forming over the underlying metal substrate an inner layer comprising a ceramic thermal barrier coating material in an amount up to 100%; and 2. forming over the inner layer an outer layer having an exposed surface, the outer layer comprising:

a. a CMAS-reactive material in an amount up to 100% and sufficient to protect the thermal barrier coating at least partially against CMAS that becomes deposited on the exposed surface, the CMAS-reactive material comprising an alkaline earth aluminate, alkaline earth aluminosilicate or mixture thereof, wherein the alkaline earth is selected from the group consisting of barium, strontium and mixtures thereof, and b. optionally a ceramic thermal barrier coating material.

The thermal barrier coating of the present invention is provided with at least partial and up to complete protection and mitigation against the adverse effects of environmental contaminant compositions that can deposit on the surface of such coatings during normal turbine engine operation. In particular, the thermal barrier coating of the present invention is provided with at least partial and up to complete protection or mitigation against the adverse effects of CMAS deposits on such coating surfaces. The CMAS-reactive material present in the outer layer of the thermal barrier coating usually combines with the CMAS deposits to form reaction products having a higher melting point that does not become molten, or alternatively has a viscosity such the molten reaction product does not flow readily at higher temperatures normally encountered during turbine engine operation. In some cases, this combined reaction product can form a glassy (typically thin) protective layer that CMAS deposits are unable or less able to adhere to. As a result, these CMAS deposits are unable to infiltrate the normally porous surface structure of the thermal barrier coating, and thus cannot cause undesired partial (or complete) delamination and spalling of the coating.

In addition, the thermal barrier coatings of the present invention are provided with protection or mitigation, in whole or in part, against the infiltration of corrosive (e.g., alkali) environmental contaminant deposits. The thermal barrier coatings of the present invention are also useful with worn or damaged coated (or uncoated) metal substrates of turbine engine parts and components so as to provide for these refurbished parts and components protection and mitigation against the adverse effects of such environmental contaminate compositions. In addition to turbine engine parts and components, the thermal barrier coatings of the present invention provide useful protection for metal substrates of other articles that operate at, or are exposed, to high temperatures, as well as to such environmental contaminate compositions.

BRIEF DESCRIPTION OF THE DRAWINGS

The FIGURE is a side sectional view of an embodiment of the thermal barrier coating and coated article of the present invention.

DETAILED DESCRIPTION OF THE INVENTION

As used herein, the term "CMAS" refers environmental contaminant compositions that contain oxides of calcium, magnesium, aluminum, silicon, and mixtures thereof. These oxides typically combine to form compositions comprising calcium-magnesium-aluminum-silicon-oxide systems (Ca—Mg—Al—SiO).

As used herein, the term "CMAS-reactive materials" refers to those materials that are capable of combining and reacting with CMAS to form combined reaction products having a higher melting point that does not become molten, or alternatively has a viscosity such that the molten reaction product does not flow readily at higher temperatures normally encountered during turbine engine operation. In some cases, this combined reaction product can form a glassy (typically thin) protective layer that CMAS deposits are unable or less able to adhere to. Suitable CMAS reactive materials comprise alkaline earth aluminates (hereafter referred to as "AEAs") and/or alkaline earth aluminosilicates (hereafter referred to as "AEASs") wherein the alkaline earth is barium, strontium, or more typically a mixture thereof. Suitable CMAS reactive materials typically comprise barium strontium aluminates (hereafter refereed to as "BSAs") and barium strontium aluminosilicates (hereafter referred to as "BSASs"). Suitable BSAs and BSASs include those comprising from about 0.00 to about 1.00 moles BaO, from about 0.00 to about 1.00 moles SrO, from about 1.00 to about 2.00 moles $Al_2O_3$ and from about 0.00 to about 2.00 moles $SiO_2$. Usually, the CMAS-reactive material comprise BSASs having from about 0.00 to about 1.00 moles BaO, from about 0.00 to about 1.00 moles SrO, about 1.00 moles $Al_2O_3$ and about 2.00 moles $SiO_2$, wherein the combined moles of BaO and SrO is about 1.00 mole. Typically, the BSASs comprise from about 0.10 to about 0.90 moles (more typically from about 0.25 to about 0.75 moles) BaO, from about 0.10 to about 0.90 moles (more typically from about 0.25 to about 0.75 moles) SrO, about 1.00 moles $Al_2O_3$ and about 2.00 moles $SiO_2$, wherein the combined moles of BaO and SrO is about 1.00 moles. A particularly suitable BSAS comprises about 0.75 moles BaO, about 0.25 moles SrO, about 1.00 moles $Al_2O_3$ and about 2.00 moles $SiO_2$. See U.S. Pat. No. 6,387,456 (Eaton et al.), issued May 14, 200, especially column 3, lines 8–27, which is herein incorporated by reference.

As used herein, the term "ceramic thermal barrier coating material" refers to those coating materials that are capable of reducing heat flow to the underlying metal substrate of the article, i.e., forming a thermal barrier. These materials usually have a melting point of at least about 2000° F. (1093° C.). typically at least about 2200° F. (1204° C.), and more typically in the range of from about 2200° to about 3500° F. (from about 1204° to about 1927° C.). Suitable ceramic thermal barrier coating materials include various zirconias, in particular chemically stabilized zirconias (i.e., various metal oxides such as yttrium oxides blended with zirconia), such as yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias as well as mixtures of such stabilized zirconias. See, for example, Kirk-Othmer's Encyclopedia of Chemical Technology, 3rd Ed., Vol. 24, pp. 882–883 (1984) for a description of suitable zirconias. Suitable yttria-stabilized zirconias can comprise from about 1 to about 20% yttria (based on the combined weight of yttria and zirconia), and more typically from about 3 to about 10% yttria. These chemically stabilized zirconias can further include one or more of a second metal (e.g., a lanthanide or actinide) oxide such as dysprosia, erbia, europia, gadolinia, neodymia, praseodymia, urania, and hafnia to further reduce thermal conductivity of the thermal barrier coating. See U.S. Pat. No. 6,025,078 (Rickersby et al), issued Feb. 15, 2000 and U.S. Pat. No. 6,333,118 (Alperine et al), issued Dec. 21, 2001, both of which are incorporated by reference. Suitable ceramic thermal barrier coating materials also include pyrochlores of general formula $A_2B_2O_7$ where A is a metal having a valence of 3+ or 2+ (e.g., gadolinium, aluminum, cerium, lanthanum or yttrium) and B is a metal having a valence of 4+ or 5+ (e.g., hafnium, titanium, cerium or zirconium) where the sum of the A and B valences is 7. Representative materials of this type include gadolinium-zirconate, lanthanum titanate, lanthanum zirconate, yttrium zirconate, lanthanum hafnate, cerium zirconate, aluminum cerate, cerium hafnate, aluminum hafnate and lanthanum cerate. See U.S. Pat. No. 6,117,560 (Maloney), issued Sep. 12, 2000; U.S. Pat. No. 6,177,200 (Maloney), issued Jan. 23, 2001; U.S. Pat. No. 6,284,323 (Maloney), issued Sep. 4, 2001; U.S. Pat. No. 6,319,614 (Beele), issued Nov. 20, 2001; and U.S. Pat. No. 6,87,526 (Beele), issued May 14, 2002, all of which are incorporated by reference.

As used herein, the term "comprising" means various compositions, compounds, components, layers, steps and the like can be conjointly employed in the present invention. Accordingly, the term "comprising" encompasses the more restrictive terms "consisting essentially of" and "consisting of."

All amounts, parts, ratios and percentages used herein are by weight unless otherwise specified.

The thermal barrier coatings of the present invention are useful with a wide variety of turbine engine (e.g., gas turbine engine) parts and components that are formed from metal substrates comprising a variety of metals and metal alloys, including superalloys, and are operated at, or exposed to, high temperatures, especially higher temperatures that occur during normal engine operation. These turbine engine parts and components can include turbine airfoils such as blades and vanes, turbine shrouds, turbine nozzles, combustor components such as liners and deflectors, augmentor hardware of gas turbine engines and the like. The thermal barrier coatings of the present invention can also cover a portion or all of the metal substrate. For example, with regard to airfoils such as blades, the thermal barrier coatings of the present invention are typically used to protect, cover or overlay portions of the metal substrate of the airfoil other than solely the tip thereof, e.g., the thermal barrier coatings cover the leading and trailing edges and other surfaces of the airfoil. While the following discussion of the thermal barrier coatings of the present invention will be with reference to metal substrates of turbine engine parts and components, it should also be understood that the thermal barrier coatings of the present invention are useful with metal substrates of other articles that operate at, or are exposed to, high temperatures, as well as being exposed to environmental contaminant compositions the same or similar to CMAS.

The various embodiments of the thermal barrier coatings of the present invention are further illustrated by reference to the drawings as described hereafter. Referring to the drawings, the FIGURE shows a side sectional view of an embodiment of the thermally barrier coating of the present invention used with the metal substrate of an article indicated generally as 10. As shown in the FIGURE, article 10 has a metal substrate indicated generally as 14. Substrate 14 can comprise any of a variety of metals, or more typically metal alloys, that are typically protected by thermal barrier coatings, including those based on nickel, cobalt and/or iron alloys. For example, substrate 14 can comprise a high temperature, heat-resistant alloy, e.g., a superalloy. Such high temperature alloys are disclosed in various references, such as U.S. Pat. No. 5,399,313 (Ross et al), issued Mar. 21, 1995 and U.S. Pat. No. 4,116,723 (Gell et al), issued Sep. 26, 1978, both incorporated herein by reference. High temperature alloys are also generally described in Kirk-Othmer's Encyclopedia of Chemical Technology, 3rd Ed., Vol. 12, pp. 417–479 (1980), and Vol. 15, pp. 787–800 (1981). Illustrative high temperature nickel-based alloys are designated by the trade names Inconel®, Nimonic®, Rene® (e.g., Rene® 80-, Rene® 95 alloys), and Udimet®. As described above, the type of substrate 14 can vary widely, but it is representatively in the form of a turbine part or component, such as an airfoil (e.g., blade) or turbine shroud.

As shown in the FIGURE, article 10 also includes a bond coat layer indicated generally as 18 that is adjacent to and overlies substrate 14. Bond coat layer 18 is typically formed from a metallic oxidation-resistant material that protects the underlying substrate 14 and enables the thermal barrier coating indicated generally as 22 to more tenaciously adhere to substrate 14. Suitable materials for bond coat layer 18 include MCrAlY alloy powders, where M represents a metal such as iron, nickel, platinum or cobalt, in particular, various metal aluminides such as nickel aluminide and platinum aluminide. This bond coat layer 18 can be applied, deposited or otherwise formed on substrate 10 by any of a variety of conventional techniques, such as physical vapor deposition (PVD), including electron beam physical vapor deposition (EBPVD), plasma spray, including air plasma spray (APS) and vacuum plasma spray (VPS), or other thermal spray deposition methods such as high velocity oxy-fuel (HVOF) spray, detonation, or wire spray, chemical vapor deposition (CVD), or combinations of such techniques, such as, for example, a combination of plasma spray and CVD techniques. Typically, a plasma spray technique, such as that used for the thermal barrier coating 22, can be employed to deposit bond coat layer 18. Usually, the deposited bond coat layer 18 has a thickness in the range of from about 1 to about 19.5 mils (from about 25 to about 500 microns). For bond coat layers 18 deposited by PVD techniques such as EBPVD, the thickness is more typically in the range of from about 1 about 3 mils (from about 25 to about 75 microns). For bond coat layers deposited by plasma spray techniques such as APS, the thickness is more typically, in the range of from about 3 to about 15 mils (from about 75 to about 385 microns).

As shown in the FIGURE, the thermal barrier coating (TBC) 22 is adjacent to and overlies bond coat layer 18. The thickness of TBC 22 is typically in the range of from about 1 to about 100 mils (from about 25 to about 2564 microns) and will depend upon a variety of factors, including the article 10 that is involved. For example, for turbine shrouds, TBC 22 is typically thicker and is usually in the range of from about 30 to about 70 mils (from about 769 to about 1795 microns), more typically from about 40 to about 60 mils (from about 1333 to about 1538 microns). By contrast, in the case of turbine blades, TBC 22 is typically thinner and is usually in the range of from about 1 to about 30 mils (from about 25 to about 769 microns), more typically from about 3 to about 20 mils (from about 77 to about 513 microns).

As shown in the FIGURE, TBC 22 comprises an inner layer 26 that is nearest to substrate 14, and is adjacent to and overlies bond coat layer 18. This inner layer 26 comprises a ceramic thermal barrier coating material in an amount of up to 100%. Typically, inner layer 26 comprises from about 95 to 100% ceramic thermal barrier coating material, and more typically from about 98 to 100% ceramic thermal barrier coating material. The composition of inner layer 26 in terms of the type of ceramic thermal barrier coating materials will depend upon a variety of factors, including the composition of the adjacent bond coat layer 18, the coefficient of thermal expansion (CTE) characteristics desired for TBC 22, the thermal barrier properties desired for TBC 22, and like factors well known to those skilled in the art. The thickness of inner layer 26 will also depend upon a variety of factors, including the overall desired thickness of TBC 22 and the particular article 10 that TBC 22 is used with. Typically, inner layer 26 will comprise from about 50 to about 99%, more typically from about 75 to about 90%, of the thickness of TBC 22.

TBC 22 further comprises an outer layer indicated generally as 30 that is adjacent to and overlies inner layer 26 and has an exposed surface 34. Outer layer 30 comprises a CMAS-reactive material in an amount up to 100% and sufficient to protect TBC 22 at least partially against CMAS contaminants that become deposited on the exposed surface 34, and optionally a ceramic thermal barrier coating material as a mixture, blend or other combination with the reactive material to make outer layer 30 more compatible (i.e., in terms of the CTEs) with inner layer 26. Typically, outer layer 30 can comprises from about 20 to 100% reactive material and from 0 to about 80% ceramic thermal barrier coating material, more typically from about 40 to about 60% reactive material and from about 40 to about 60% ceramic thermal barrier coating material. When the CMAS-reactive material comprises BSAS, the CMAS-reactive material in outer layer 30 is typically formulated to have a crystallographic structure of at least about 50% by volume celsian. See U.S. Pat. No. 6,387,456 (Eaton et al.), issued May 14, 2002, especially column 3, lines 38–42, which is herein incorporated by reference. The composition of outer layer 30 in terms of the amount and type of reactive material (and optional ceramic thermal barrier coating material) will depend upon a variety of factors, including the composition of the adjacent inner layer 26, the CTE characteristics desired for TBC 22, the environmental contaminant protective properties desired, and like factors well known to those skilled in the art. Typically, outer layer 30 will comprise from about 1 to about 50% of the thickness of TBC 22, and more typically from about 10 to about 25% of the thickness of TBC 22.

Referring to the FIGURE, TBC 22 can be applied, deposited or otherwise formed on bond coat layer 18 by any of a variety of conventional techniques, including as physical vapor deposition (PVD), such as electron beam physical vapor deposition (EBPVD), plasma spray, such as air plasma spray (APS) and vacuum plasma spray (VPS), or other thermal spray deposition methods such as high velocity oxy-fuel (HVOF) spray, detonation, or wire spray; chemical vapor deposition (CVD), or combinations of plasma spray and CVD techniques. The particular technique used for applying, depositing or otherwise forming TBC 22 will typically depend on the composition of TBC 22, its thickness and especially the physical structure desired for TBC. For example, PVD techniques tend to be useful in forming TBCs having a porous strain-tolerant columnar structure with grooves, crevices or channels formed in at least inner layer 26. By contrast, plasma spray techniques (e.g., APS) tend to create a sponge-like porous structure of open pores in at least inner layer 26. Typically, TBCs 22 are formed by plasma spray techniques in the method of the present invention.

Various types of plasma-spray techniques well known to those skilled in the art can be utilized to apply the CMAS-reactive and ceramic thermal barrier coating materials in forming the TBCs 22 of the present invention. See, for example, Kirk-Othmer Encyclopedia of Chemical Technology, 3rd Ed., Vol. 15, page 255, and references noted therein, as well as U.S. Pat. No. 5,332,598 (Kawasaki et al), issued Jul. 26, 1994; U.S. Pat. No. 5,047,612 (Savkar et al) issued Sep. 10, 1991; and U.S. Pat. No. 4,741,286 (Itoh et al), issued May 3, 1998 (herein incorporated by reference) which are instructive in regard to various aspects of plasma spraying suitable for use herein. In general, typical plasma spray techniques involve the formation of a high-temperature plasma, which produces a thermal plume. The CMAS-reactive and ceramic thermal barrier coating materials, e.g., ceramic powders, are fed into the plume, and the high-velocity plume is directed toward the bond coat layer 18. Various details of such plasma spray coating techniques will be well-known to those skilled in the art, including various relevant steps and process parameters such as cleaning of the bond coat surface 18 prior to deposition; grit blasting to remove oxides and roughen the surface substrate temperatures, plasma spray parameters such as spray distances (gun-to-substrate), selection of the number of spray-passes, powder feed rates, particle velocity, torch power, plasma gas selection, oxidation control to adjust oxide stoichiometry, angle-of-deposition, post-treatment of the applied coating; and the like. Torch power can vary in the range of about 10 kilowatts to about 200 kilowatts, and in preferred embodiments, ranges from about 40 kilowatts to about 60 kilowatts. The velocity of the CMAS-reactive and ceramic thermal barrier coating material particles flowing into the plasma plume (or plasma "jet") is another parameter which is usually controlled very closely.

Suitable plasma spray systems are described in, for example, U.S. Pat. No. 5,047,612 (Savkar et al) issued Sep. 10, 1991, which is incorporated by reference. Briefly, a typical plasma spray system includes a plasma gun anode which has a nozzle pointed in the direction of the deposit-surface of the substrate being coated. The plasma gun is often controlled automatically, e.g., by a robotic mechanism, which is capable of moving the gun in various patterns across the substrate surface. The plasma plume extends in an axial direction between the exit of the plasma gun anode and the substrate surface. Some sort of powder injection means is disposed at a predetermined, desired axial location between the anode and the substrate surface. In some embodiments of such systems, the powder injection means is spaced apart in a radial sense from the plasma plume region, and an injector tube for the powder material is situated in a position so that it can direct the powder into the plasma plume at a desired angle. The powder particles, entrained in a carrier gas, are propelled through the injector and into the plasma plume. The particles are then heated in the plasma and propelled toward the substrate. The particles melt, impact on the substrate, and quickly cool to form the thermal barrier coating.

In forming the TBCs 22 of the present invention, the inner layer 26 is initially formed on bond coat layer 18, followed by outer layer 30. In forming TBCs 22 of the present invention, the inner layer 26 is typically formed by depositing the ceramic thermal barrier coating material on bond coat layer 18, followed by depositing the CMAS-reactive material to form outer layer 30, or codepositing the combination of the CMAS-reactive material and ceramic thermal barrier coating material in a manner that allows the CMAS-reactive material and ceramic thermal barrier coating material to bend, mix or otherwise combine together as a homogeneous or substantially homogeneous mixture so as to form outer layer 30. Codepositing can be achieved by blending, mixing or otherwise combining the CMAS-reactive material and ceramic thermal barrier coating material together (e.g., as powders) to provide a homogeneous or substantially homogeneous mixture that is then deposited onto inner layer 26, by separately depositing onto inner layer 26 (e.g., as separate plasma spray streams) the respective CMAS-reactive material and ceramic thermal barrier coating material in a manner such that these materials blend, mix or otherwise combine together to form a homogeneous or substantially homogeneous mixture, or any combination thereof. If desired, the particular ratio and/or amount of the CMAS-reactive material and ceramic thermal barrier coating material can be varied as it is deposited on bond coat layer 18 to provide compositions and CTEs that vary through the thickness of TBC 22, as well as to provide a convenient method for forming respective inner layer 26, followed by outer layer 30. Indeed, the various layers (i.e., inner layer 26 and outer layer 30) of TBC 22 can be formed conveniently by adjusting the ratio and/or amount of the CMAS-reactive material and ceramic thermal barrier coating material as it is progressively and sequentially deposited on bond coat layer 18. When the CMAS-reactive material in outer layer 30 comprises BSAS, the CMAS-reactive material is typically thermally sprayed on inner layer 26 at a temperature from about from about 465° to about 649° F. (from about 870° to about 1200° C.) to develop a celsian crystallographic structure in at least about 50% by volume of the CMAS reactive material. See U.S. Pat. No. 6,387,456 (Eaton et al.), issued May 14, 2002, especially column 4, lines 25–35, which is herein incorporated by reference.

The method of the present invention is particularly useful in providing protection or mitigation against the adverse effects of such environmental contaminate compositions for TBCs used with metal substrates of newly manufactured articles. However, the method of the present invention is also useful in providing such protection or mitigation against the adverse effects of such environmental contaminate compositions for refurbished worn or damaged TBCs, or in providing TBCs having such protection or mitigation for articles that did not originally have a TBC.

While specific embodiments of the method of the present invention have been described, it will be apparent to those skilled in the art that various modifications thereto can be made without departing from the spirit and scope of the present invention as defined in the appended claims.

What is claimed is:

1. A thermally protected article, which comprises:

1. a metal substrate;
2. a bond coat layer adjacent to and overlaying the metal substrate; and
3. a thermal barrier coating comprising:
   a. an inner thermal barrier layer comprising from about 75 to about 99% of the thickness of the thermal barrier coating and being adjacent to and overlaying the bond coat layer, the inner layer comprising from about 95 to 100% of a ceramic thermal barrier coating material selected from the group consisting of zirconias and pyrochlores of general formula $A_2B_2O_7$ where A is a metal having a valence of 3+ or 2+ selected from the group consisting of gadolinium, aluminum, cerium, lanthanum and yttrium, and B is a metal having a valence of 4+ or 5+ selected from the group consisting of hafnium, titanium, cerium and zirconium, and wherein the sum of the A and B valences is 7; and
   b. a CMAS-protective outer layer comprising from about 1 to about 25% of the thickness of the thermal barrier coating and being adjacent to and overlaying the inner layer and having an exposed surface, the outer layer comprising:
      (1) a CMAS-reactive material in an amount up to 100% and sufficient to protect the thermal barrier coating at least partially against CMAS that becomes deposited on the exposed surface, the CMAS-reactive material comprising an alkaline earth aluminate, alkaline earth aluminosilicate or mixture thereof, wherein the alkaline earth is selected from the group consisting of barium, strontium and mixtures thereof; and
      (2) optionally a ceramic thermal barrier coating material.

2. The article of claim 1 wherein the thermal barrier coating has a thickness of from about 1 to about 100 mils and wherein the inner layer comprises from about 75 to about 90% of the thickness of the thermal barrier coating and wherein the outer layer comprises from about 10 to about 25% of the thickness of the thermal barrier coating.

3. The article of claim 2 wherein the outer layer comprises from about 40 to about 60% CMAS-reactive material and from about 40 to about 60% ceramic thermal barrier coating material.

4. The article of claim 3 wherein the ceramic thermal barrier coating material is a yttria stabilized zirconia.

5. The article of claim 4 wherein the thermal barrier coating has a thickness of from about 1 to about 100 mils and wherein the inner layer comprises from about 50 about 99% of the thickness of the thermal barrier coating and wherein the outer layer comprises from about 1 to about 50% of the thickness of the thermal barrier coating.

6. The article of claim 5 wherein the inner layer comprises from about 75 about 90% of the thickness of the thermal barrier coating and wherein the outer layer comprises from about 10 to about 25% of the thickness of the thermal barrier coating.

7. The article of claim 5 wherein the CMAS-reactive material comprises from about 0.00 to about 1.00 moles BaO, from about 0.00 to 1.00 moles SrO, from about 1.00 to about 2.00 moles $Al_2O_3$ and from about 0.00 to about 2.00 moles $SiO_2$.

8. The article of claim 7 wherein the CMAS-reactive material comprises front about 0.10 to about 0.90 moles BaO, from about 0.10 to about 0.90 moles SrO, about 1.00 moles $Al_2O_3$ and about 2.00 moles $SiO_2$, and wherein the combined moles of BaO and SrO is about 1.00 moles.

9. The article of claim 8 wherein the CMAS-reactive material comprises from about 0.25 to about 0.75 moles BaO and from about 0.25 to about 0.75 moles SrO.

10. The article of claim 9 wherein the CMAS-reactive material is at least about 50% by volume celsian.

11. The article of claim 5 wherein the inner layer comprises from about 95 to 100% zirconia and wherein the outer layer comprises from about 40 to about 60% CMAS-reactive material and from about 40 to about 60% zirconia, the CMAS-reactive material comprising from about 0.10 to about 0.90 moles BaO, from about 0.10 to about 0.90 moles SrO, about 1.00 moles $Al_2O_3$ and about 2.00 moles $SiO_2$, and wherein the combined moles of BaO and SrO is about 1.00 moles.

12. The article of claim 11 wherein the inner layer comprises from about 98 to 100% of a yttria-stabilized zirconia and wherein the outer layer comprises from about 40 to about 60% CMAS-reactive material and from about 40 to about 60% of a yttria-stabilized zirconia.

13. The article of claim 5 which is a turbine engine component.

14. The component of claim 13 which is a turbine shroud and wherein the thermal barrier coating has a thickness of from about 30 to about 70 mils.

15. The shroud of claim 14 wherein the thermal barrier coating has a thickness of from about 40 to about 60 mils.

16. The article of claim 1 wherein the CMAS-reactive material comprises from about 0.00 to about 1.00 moles BaO, from about 0.00 to about 1.00 moles SrO, from about 1.00 to about 2.00 moles $Al_2O_3$ and from about 0.00 to about 2.00 moles $SiO_2$.

17. The article of claim 16 wherein the CMAS-reactive material comprises from about 0.10 to about 0.90 moles BaO, from about 0.10 to about 0.90 moles SrO, about 1.00 moles $Al_2O_3$ and about 2.00 moles $SiO_2$, and wherein the combined moles of BaO and SrO is about 1.00 moles.

18. The article of claim 17 wherein the CMAS-reactive material comprises from about 0.25 to about 0.75 moles BaO and from about 0.25 to about 0.75 moles SrO.

19. The article of claim 18 wherein the CMAS-reactive material is at least about 50% by volume celsian.

20. The article of claim 16 wherein the outer layer comprises from about 20 to 100% CMAS-reactive material and from 0 to about 80% ceramic thermal barrier coating material.

21. The article of claim 20 wherein the inner layer comprises from about 95 to 100% zirconia and wherein the outer layer comprises from about 40 to about 60% CMAS-reactive material and from about 40 to about 60% zirconia, the CMAS-reactive material comprising from about 0.10 to about 0.90 moles BaO, from about 0.10 to about 0.90 moles SrO, about 1.00 moles $Al_2O_3$ and about 2.00 moles $SiO_2$, and wherein the combined moles of BaO and SrO is about 1.00 moles.

22. The article of claim 21 wherein the inner layer comprises from about 98 to 100% of a yttria-stabilized zirconia and wherein the outer layer comprises from about 40 to about 60% CMAS-reactive material and from about 40 to about 60% of a yttria-stabilized zirconia.

23. A thermally protected article, which comprises:

1. a metal substrate;
2. a bond coat layer adjacent to and overlaying the metal substrate and
3. a thermal barrier coating comprising:
   a. an inner thermal barrier layer adjacent to and overlaying the bond coat layer, the inner layer comprising from about 95 to 100% of a ceramic thermal barrier coating material selected from the group consisting of zirconias and pyrochlores of general formula $A_2B_2O_7$ where A is a metal having a valence of 3+ or 2+ selected from the group consisting of gadolinium, aluminum, cerium, lanthanum and yttrium, and B is a metal having a valence of 4+ or 5+ selected from the group consisting of hafnium, titanium, cerium and zirconium, and wherein the sum of the A and B valences is 7; and
   b. a CMAS-protective outer layer adjacent to and overlaying the inner layer and having an exposed surface, the outer layer comprising:
      (1) front about 40 to about 60% of a CMAS-reactive material to protect the thermal barrier coating at least partially against CMAS that becomes deposited on the exposed surface, the CMAS-reactive material comprising an alkaline earth aluminate, alkaline earth aluminosilicate or mixture thereof, wherein the alkaline earth is selected from the group consisting of barium, strontium and mixtures thereof; and
      (2) from about 40 to about 60% of a ceramic thermal barrier coating material selected from the group consisting of chemically stabilized zirconias and pyrochlores of general formula $A_2B_2O_7$ where A is a metal having a valence of 3+ or 2+ selected from the group consisting of gadolinium, aluminum, cerium, lanthanum and yttrium, and B is a metal having a valence of 4+ or 5+ selected from the group consisting of hafnium, titanium, cerium and zirconium, and wherein the sum of the A and B valences is 7.

24. A method for preparing a thermal barrier coating on a bond coat layer that is adjacent to and overlies a metal substrate, the method comprising the steps of:

1. forming over the bond coat layer an inner thermal barrier layer comprising from about 75 to about 99% of the thickness of the thermal barrier coating, the inner layer comprising from about 95 to 100% of a ceramic thermal barrier coating material selected from the group consisting of zirconias and pyrochlores of general formula $A_2B_2O_7$ where A is a metal having a valence of 3+ or 2+ selected from the group consisting of gadolinium, aluminum, cerium, lanthanum and yttrium, and B is a metal having a valence of 4+ or 5+ selected from the group consisting of hafnium, titanium, cerium and zirconium, and wherein the sum of the A and B valences is 7;
2. forming over the inner layer a CMAS-protective outer layer comprising from about 1 to about 25% of the thickness of the thermal barrier coating, the outer layer having an exposed surface and comprising:
   a. a CMAS-reactive material in an amount up to 100% and sufficient to protect the thermal barrier coating at least partially against CMAS that becomes deposited on the exposed surface, the CMAS-reactive material comprising an alkaline earth aluminate, alkaline earth aluminosilicate or mixture thereof, wherein the alkaline earth is selected from the group consisting of barium, strontium and mixtures thereof; and
   b. optionally a ceramic thermal barrier coating material.

25. The method of claim 24 wherein step (2) is carried out by combining the CMAS-reactive material and the ceramic thermal barrier coating material to form a substantially homogeneous mixture and then depositing the mixture on the inner layer.

26. The method of claim 25 wherein step (2) is carried out by depositing a separate stream of the CMAS-reactive material and a separate stream of the ceramic thermal barrier coating material on the inner layer in a manner such that the CMAS-reactive material and the ceramic thermal barrier coating material combine together to form a substantially homogeneous mixture.

27. The method of claim 25 wherein the inner layer is formed in step (1) by plasma spraying the ceramic thermal barrier coating material on the bond coat layer.

28. The method of claim 27 wherein step (2) is carried out by combining the CMAS-reactive material and the ceramic thermal barrier coating material to form a substantially homogeneous mixture and then plasma spraying the mixture on the inner layer.

29. The method of claim 27 wherein step (2) is carried out by plasma spraying a separate stream of the CMAS-reactive material and a separate stream of the ceramic thermal barrier coating material on the inner layer in a manner such that the CMAS-reactive material and the ceramic thermal barrier coating material blend together to form a substantially homogeneous mixture.

30. The method of claim 27 wherein step (2) is carried out by plasma spraying a separate stream of the CMAS-reactive material and a separate stream of the ceramic thermal barrier coating material on the inner layer in a manner such that the CMAS-reactive material and the ceramic thermal barrier coating material combine together to form a substantially homogeneous mixture.

31. The method of claim 24 wherein the inner layer deposited during step (1) comprises from about 75 to about 95% of the thickness of the thermal barrier coating and wherein the outer layer deposited during step (2) comprises from about 10 to about 25% of the thickness of the thermal barrier coating.

* * * * *